US010668479B2

(12) United States Patent
Guoguang et al.

(10) Patent No.: US 10,668,479 B2
(45) Date of Patent: Jun. 2, 2020

(54) PAPER SHREDDER

(71) Applicant: GUANGZHOU SUNSHINE COMET ELECTRONIC TECHNOLOGY CO., LTD., Guangdong (CN)

(72) Inventors: Li Guoguang, Guangdong (CN); Xu Yifeng, Guangdong (CN)

(73) Assignee: GUANGZHOU SUNSHINE COMET ELECTRONIC TECHNOLOGY CO., LTD., Guangzhou, Guangdong (CN)

( * ) Notice: Subject to any disclaimer, the term of this patent is extended or adjusted under 35 U.S.C. 154(b) by 377 days.

(21) Appl. No.: 15/642,818

(22) Filed: Jul. 6, 2017

(65) Prior Publication Data

US 2018/0008988 A1 Jan. 11, 2018

(30) Foreign Application Priority Data

Jul. 6, 2016 (CN) ..... 2016 1 0531628

(51) Int. Cl.

| | |
|---|---|
| ***B02C 18/00*** | (2006.01) |
| ***B02C 18/22*** | (2006.01) |
| ***B02C 18/14*** | (2006.01) |
| ***B02C 18/16*** | (2006.01) |

(52) U.S. Cl.

CPC ..... *B02C 18/0007* (2013.01); *B02C 18/2283* (2013.01)

(58) Field of Classification Search

CPC ..... B02C 18/0007; B02C 18/2283; B02C 18/0015; B02C 18/003; B02C 18/2225; B02C 18/14; B02C 18/16; B02C 18/142; B02C 2018/0061; B02C 2018/0015; B02C 2018/003

See application file for complete search history.

(56) References Cited

U.S. PATENT DOCUMENTS

| | | | | |
|---|---|---|---|---|
| 7,510,179 | B2 * | 3/2009 | Kim | B65H 3/06 271/109 |
| 7,992,858 | B2 * | 8/2011 | Sagawa | B65H 3/06 271/10.01 |
| 2008/0210794 | A1 * | 9/2008 | Schwelling | B02C 18/0007 241/225 |
| 2011/0253824 | A1 * | 10/2011 | Aries | B02C 18/0007 241/222 |

* cited by examiner

*Primary Examiner* — Adam J Eiseman
*Assistant Examiner* — Mohammed S. Alawadi
(74) *Attorney, Agent, or Firm* — Ladas & Parry LLP

(57) ABSTRACT

A paper shredder includes a chassis on which an automatic paper feeding opening is defined, a paper shredding mechanism, a paper separating mechanism located adjacent to the automatic paper feeding opening, and a paper pickup mechanism located between the paper separating mechanism and paper shredding mechanism. The paper separating mechanism includes a first paper supporting board on which a fastening mechanism is provided and a paper separating board cooperating with the fastening mechanism. The paper pickup mechanism includes a holding bracket, a paper pickup roller axe, a plurality of paper pickup rollers sleeved on the axe, a second paper supporting board located below the plurality of rollers and secured onto the second paper supporting board, and a third paper supporting board located above a distal end of the second paper supporting board and connected with the paper separating mechanism.

5 Claims, 5 Drawing Sheets

PAPER SHREDDER

FIELD OF THE INVENTION

The present invention relates to office equipment and more particularly, to a paper shredder.

BACKGROUND OF THE INVENTION

For a general paper shredder, a user has to hold paper sheet in hand and then feed it into a shredder opening for performing shredding of paper sheet. However in our everyday life and work, usually a great number of papers should be shredded by a paper shredder. Necessarily the user has to stay at the shredder and continuously feed sheets of paper into the shredder opening. At present, paper shredders with automatic paper-feeding function have emerged into the market, and there is no need for the user to stay at the shredder and feed paper sheets, thereby effectively improving efficiency of the user.

However, this kind of paper shredder is limited to work only with a single paper sheet and is hard to shred multiple paper sheets which are adhered to each other. In other words, it is necessary for the user to manually remove staples from the paper sheets or manually separate paper sheets and then shred these paper sheets. Otherwise, the shredder will be jammed and paper shredding will stop to work. Additionally, the shredder might be damaged due to jamming.

SUMMARY OF THE INVENTION

One object of the present invention is to overcome drawbacks of prior art and provide a paper shredder capable of shredding multiple sheets of paper at one time.

To realize this object, one embodiment of the disclosure provides the following technical solution.

A paper shredder, includes a chassis on which an automatic paper feeding opening is defined, a paper shredding mechanism disposed inside the chassis, a paper separating mechanism located adjacent to the automatic paper feeding opening, and a paper pickup mechanism located between the paper separating mechanism and paper shredding mechanism.

The paper separating mechanism includes a first paper supporting board on which a fastening mechanism is provided and a paper separating board cooperating with the fastening mechanism and capable of being fixed onto the first paper supporting board, the first paper supporting board defining together with the paper separating board a paper supporting area for receiving paper sheets to be shredded.

The paper pickup mechanism includes a holding bracket secured on the chassis, a paper pickup roller axe mounted on the holding bracket, a plurality of paper pickup rollers sleeved on the axe, a second paper supporting board located below the plurality of rollers and secured onto the second paper supporting board, and a third paper supporting board located above a distal end of the second paper supporting board and connected with the paper separating mechanism.

Preferably, the fastening mechanism includes a pair of holding posts disposed at two lateral sides of the first paper supporting board respectively.

Preferably, the upper portion of the paper separating board is provided with a plurality of saw teeth Preferably, a front end of the paper separating board is hinged to the chassis.

Preferably, the lower portion of the first paper supporting board is hinged to the chassis.

Preferably, the paper pickup mechanism further includes a friction cushion located between the paper pickup rollers and second paper supporting board; and a first aperture is defined in the friction cushion and faces the paper pickup rollers.

Preferably, the paper pickup mechanism further includes a paper feeding board which is located between the third paper supporting board and friction cushion and one end of which is exposed out of a front end of the third paper supporting board; and a second aperture 2 is defined in the paper feeding board at a location corresponding to the first aperture 2 of the friction cushion.

Preferably, the paper feeding board is made of metal.

Preferably, the second paper supporting board is hinged to the holding bracket; and a resilient member is disposed below a distal end of the second paper supporting board, the resilient member being resiliently pressed against the second paper supporting board.

Preferably, the resilient member is a compression spring or resilient tab.

The paper shredder further includes a paper guiding unit mounted on the holding bracket and located in front of the paper pickup rollers; and a guiding path is defined in the paper guiding unit for guiding paper sheets.

Preferably, the paper guiding unit includes a first guiding shaft mounted on the holding bracket and parallel to the paper pickup roller axe, and a second guiding shaft; a plurality of first guiding rollers is provided on the first guiding shaft and similarly, a plurality of second guiding rollers is provided on the second guiding shaft; and the first guiding rollers and second guiding rollers together define the guiding path.

Compared to prior art, the various embodiments of the invention bring the following good effects.

For the paper shredder of the current invention, paper shredding may be realized with respect to multiple attached paper sheets automatically, human intervention is reduced, and operation efficiency is also improved.

In the paper shredder of various embodiments of the invention, the paper separating board may be secured onto the first paper supporting board. When the paper sheets are attached with each other and attached area of the sheets is away from the automatic paper feeding opening, the rollers of the shredder drive the uppermost paper sheet. The attached area of the sheets is obstructed by the paper separating board such that the uppermost paper sheet is automatically separated from other sheets under force of the rollers and cutters, thus realizing automatic separation of multiple attached paper sheets.

Moreover, when the paper sheets are attached with each other and attached area of the sheets is close to the automatic paper feeding opening, the paper separating mechanism will not properly work for these attached paper sheets. However, a friction cushion below the rollers increases friction force between the bottommost paper sheet and paper pickup mechanism so that the bottommost paper sheet together with the uppermost paper sheet will be driven into the cutters when the rollers drive the uppermost paper sheet. When the multiple paper sheets are attached together, the attached area will at first contact the rollers and therefore, the attached paper sheets will move altogether into the paper shredding mechanism.

The front end of the second paper supporting board is provided with the axe hinged onto the chassis such that the same board is rotatable relative to the axe. Furthermore, a resilient member is disposed below a distal end of the second paper supporting board and is pressed against the same board. In case the total thickness of the paper sheets is large, the resilient member is compressed to move downward in response to the thickness of the sheets such that the sheets will smoothly move forward. In addition after the sheets pass the second paper supporting board, the same board will again move upward to its original position.

DETAILED DESCRIPTION OF THE INVENTION

Various embodiments of the invention will be described below in further detail with reference to the accompanying drawings.

FIGS. 1-5 together show a paper shredder 1 in accordance with a first embodiment of the instant invention. This shredder is shown to have a manual paper feeding opening 102 and an automatic paper feeding opening 104 for manual paper feeding and automatic paper feeding respectively.

Figure 1:
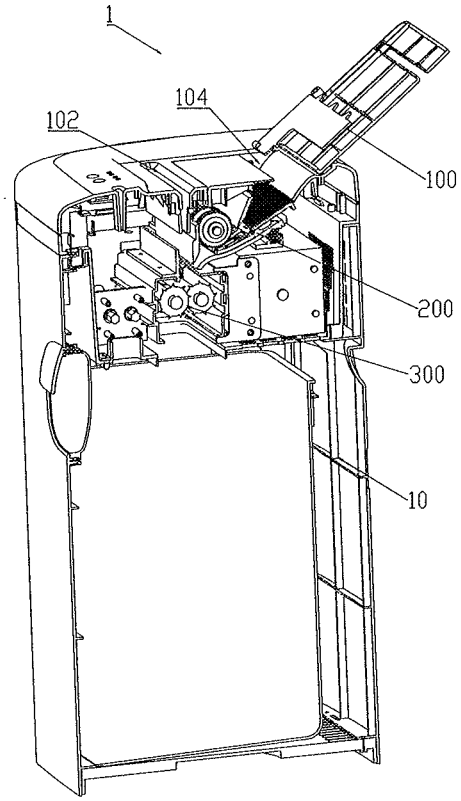
FIG. 1 is a perspective view of a paper shredder according to a first embodiment of the invention with an enclosure removed, showing interior construction of the paper shredder.
Figure 2:
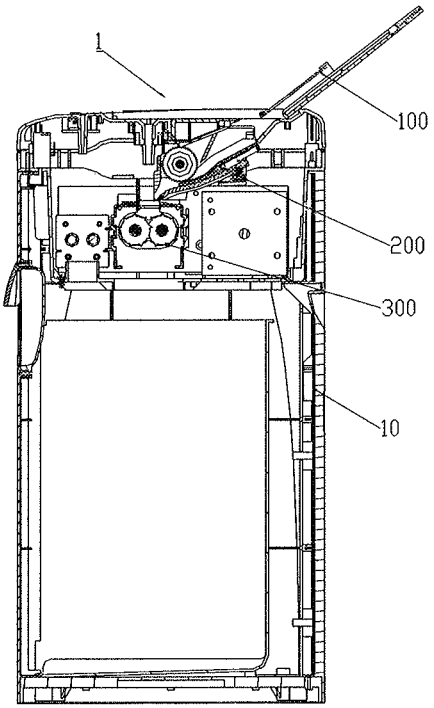
FIG. 2 shows a cross-sectional view of the paper shredder of FIG. 1.

As shown in FIGS. 1 and 2, the paper shredder 1 includes a chassis 10 on which the paper feeding openings 102 and 104 are defined, a paper separating mechanism 100 located adjacent to the automatic paper feeding opening 104, a paper pickup mechanism 200 and a paper shredding mechanism 300 both of which are located inside the chassis 10. A plurality of cutters is provided for the paper shredding mechanism 300 for shredding paper sheets or optic discs. For clarity, it is defined that during paper shredding a leading end along a moving direction of the paper sheets is a front end, while a trailing end along the same direction is a rear end.

Figure 3:
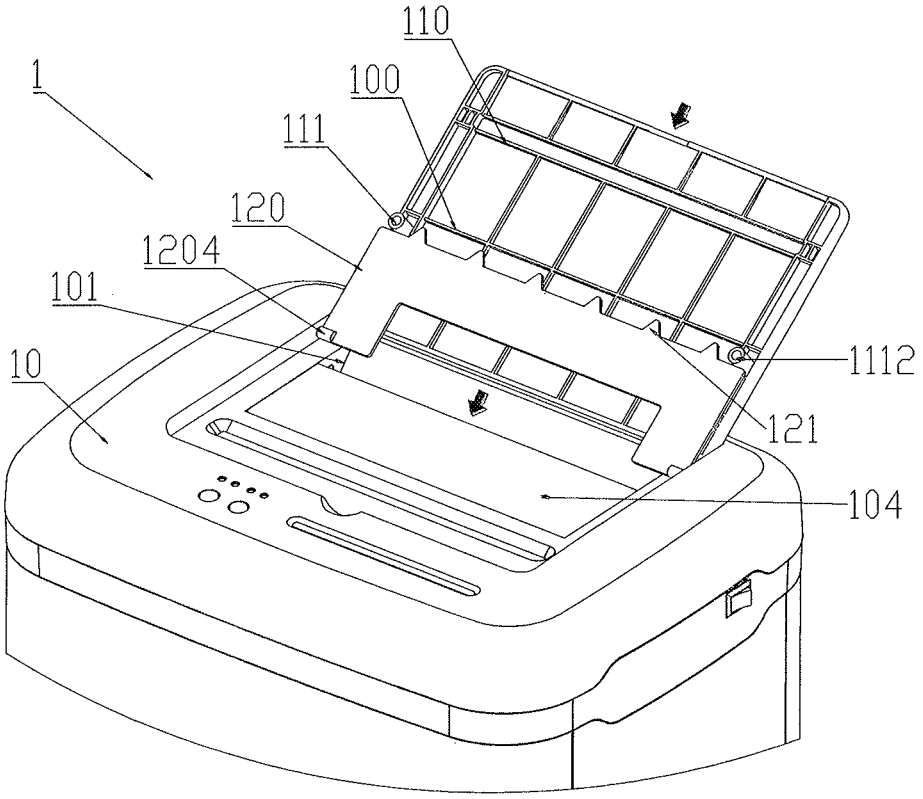
FIG. 3 denotes a perspective view of a paper separating mechanism of the paper shredder in accordance with one embodiment of the invention.

As shown in FIG. 3, the paper separating mechanism 100 includes a first paper supporting board 110 on which a fastening mechanism 111 is provided, and a paper separating board 120 cooperating with the fastening mechanism 111 and capable of being fixed onto the first paper supporting board 110. The first paper supporting board 110 defines together with the paper separating board 120 a paper supporting area for receiving paper sheets to be shredded.

In this embodiment, the fastening mechanism 111 includes a pair of holding posts 112 disposed at two lateral sides of the first paper supporting board 110 respectively. An upper end of the paper separating board 120 is pressed against the holding posts 112 in a rotatable manner. In other embodiments, the fastening mechanism 111 may also take of the form of bayonet structure, screw, or rivet.

On one hand, during paper sheets are transported from the paper pickup mechanism 200 to the paper shredding mechanism 300, the paper separating board 120 stops attached paper sheets to move forward. As such, the paper sheets are separated from each other by cooperation of the paper pickup mechanism 200 and paper separating board 120. On the other hand, the paper separating board 120 is pressed upwardly against the first paper supporting board 110 to prevent the first paper supporting board 110 being rotated towards and covered onto the automatic paper feeding opening 104 when pulled by a large force.

Figure 4:
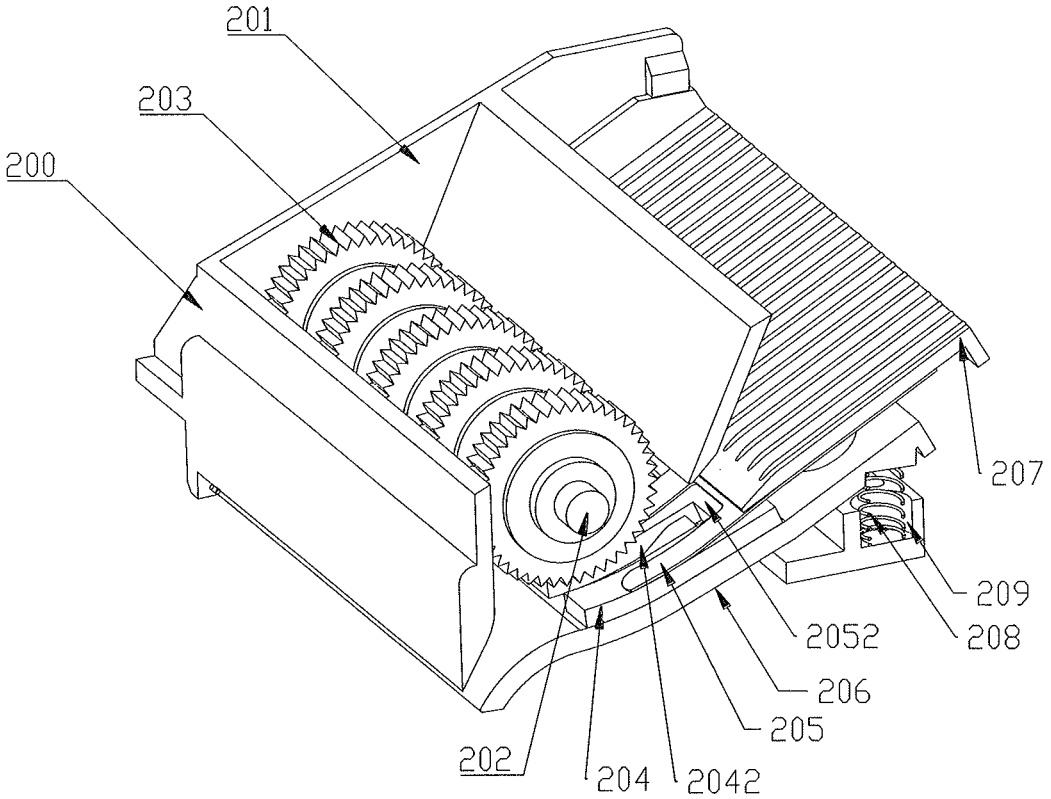
FIG. 4 shows a perspective view of a paper pickup mechanism of the paper shredder in accordance with one embodiment of the invention.
Figure 5:
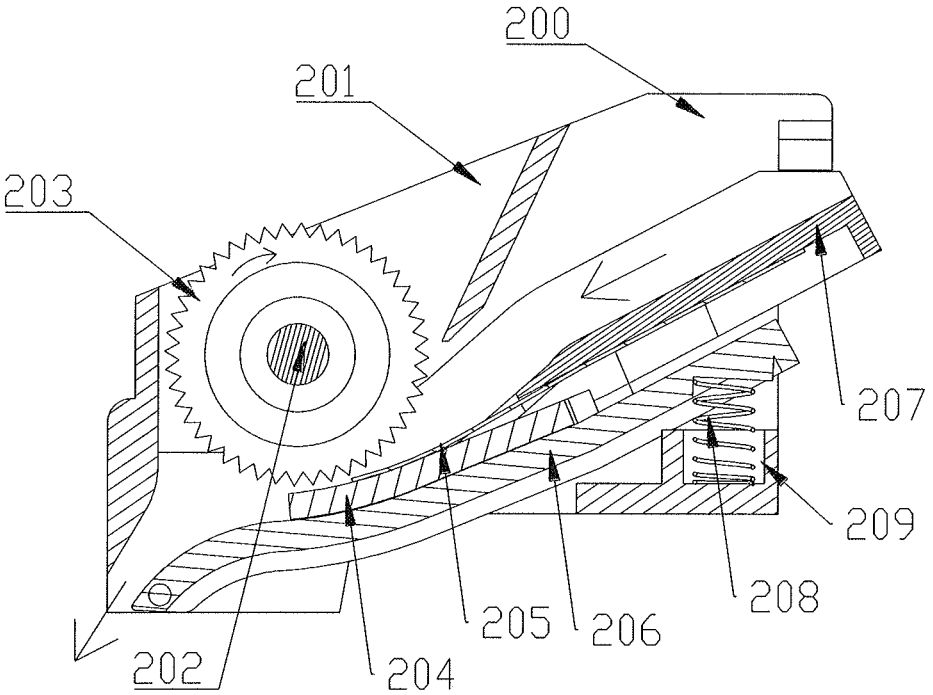
FIG. 5 shows a side view of a paper pickup mechanism of the paper shredder in accordance with one embodiment of the invention.
Figure 6:
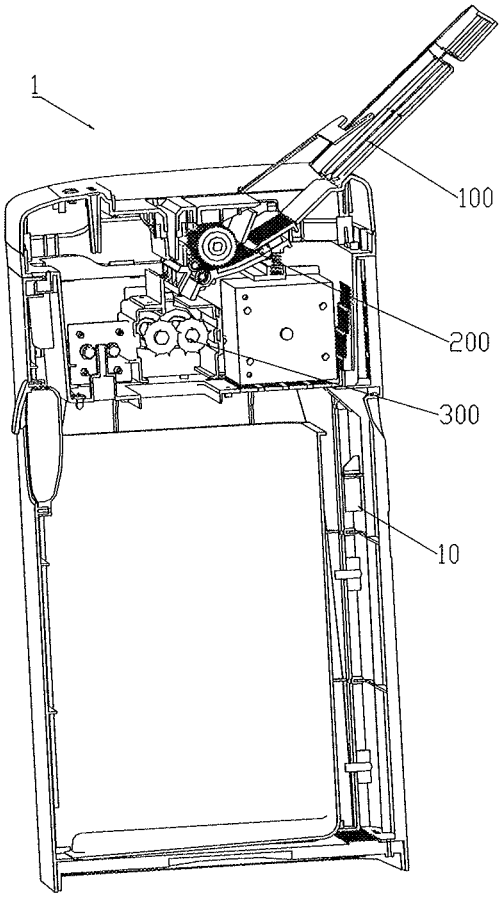
FIG. 6 is a perspective view of a paper shredder according to a second embodiment of the invention with an enclosure removed, showing interior construction of the paper shredder.
Figure 7:
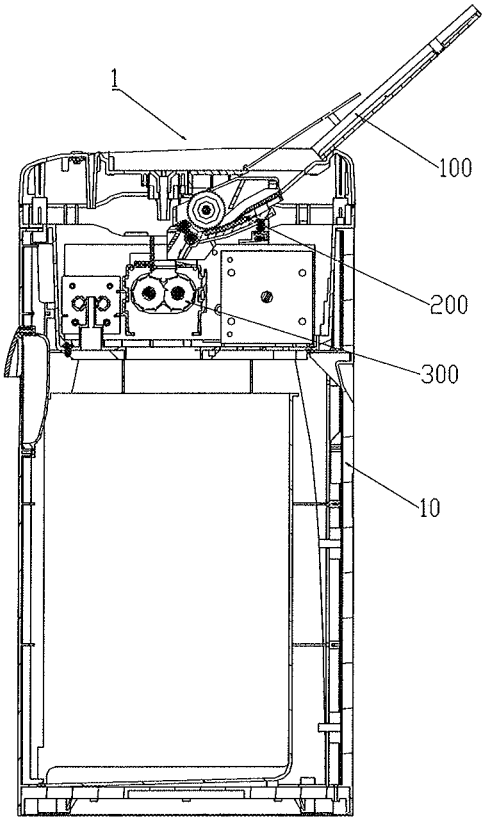
FIG. 7 shows a cross-sectional view of the paper shredder of FIG. 6.
Figure 8:
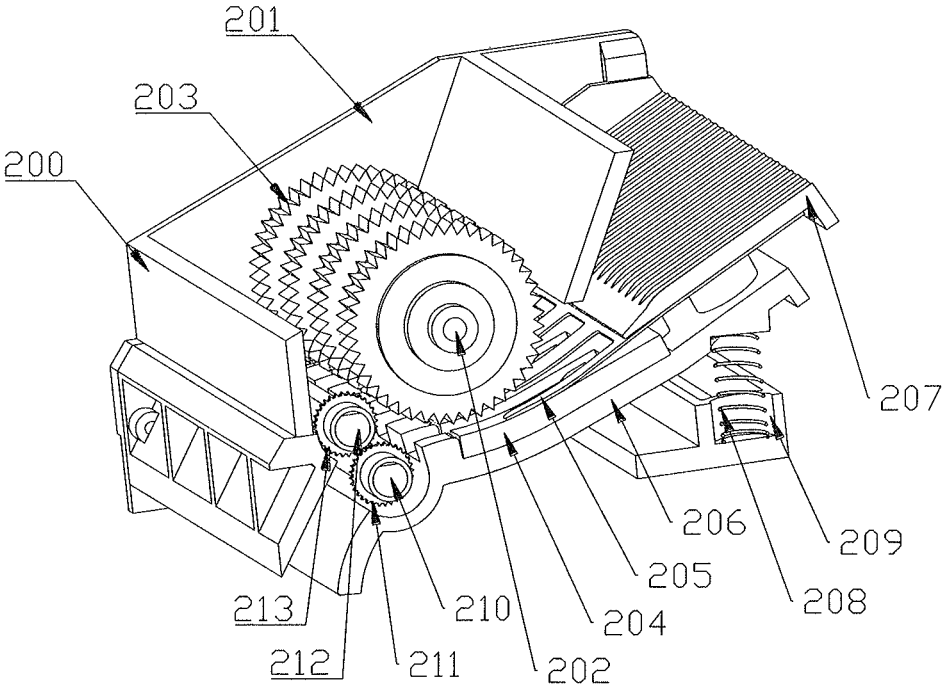
FIG. 8 shows a perspective view of a paper pickup mechanism of the paper shredder shown in FIG. 6.
Figure 9:
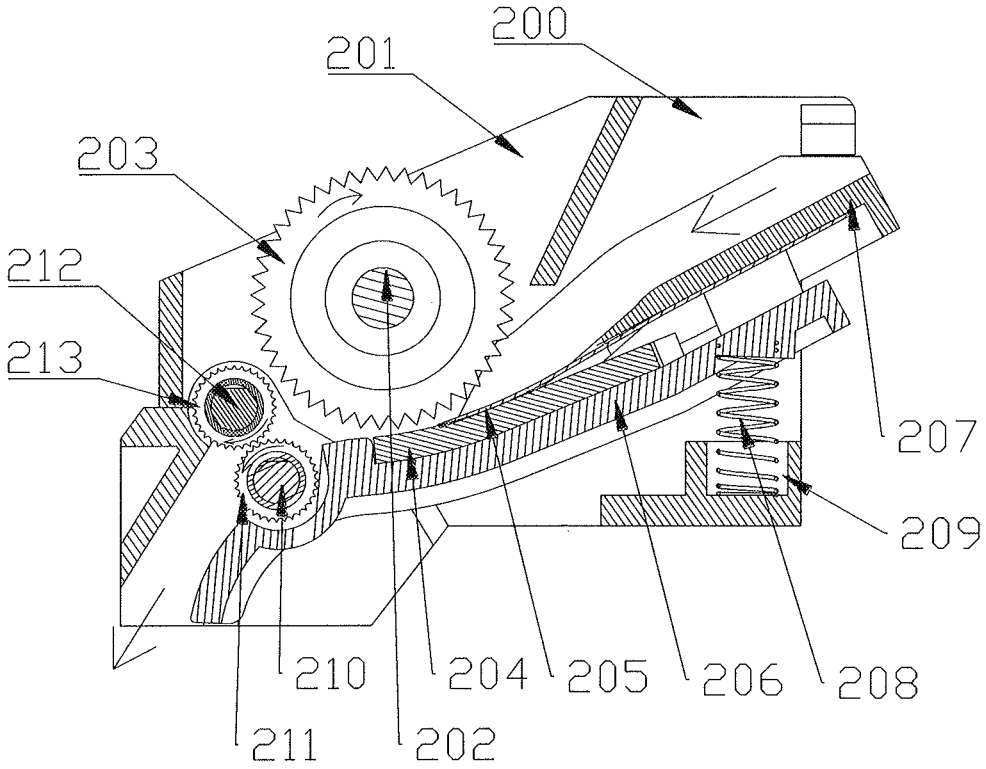
FIG. 9 shows a side view of a paper pickup mechanism of the paper shredder shown in FIG. 6.

Reference is made to FIGS. 4 and 5. The paper pickup mechanism 200 includes a holding bracket 201, a paper pickup roller axe 202 mounted on the holding bracket 201, a plurality of paper pickup rollers 203 sleeved on the axe 202, a second paper supporting board 206 located below the plurality of rollers 203 and secured onto the second paper supporting board 206, and a third paper supporting board 207 located above a distal end of the second paper supporting board 206 and connected with the paper separating mechanism 100.

In this embodiment, there are five paper pickup rollers 203 arranged on the axe 202 with certain pitch. In other embodiments, the number of the rollers 203 may be changed based on actual requirements.

To increase friction between the paper pickup mechanism 200 and bottommost paper sheet, the paper pickup mechanism 200 further includes a friction cushion 204 located below the paper pickup rollers 203 and having a first aperture 2042. The first aperture 2042 is arranged to face the rollers 203 and as a result, a bottom portion of each roller 203 may partially pass through the first aperture 2042. The friction cushion 204 may be made of rubber or other material with great friction such as silica gel. The friction cushion 204 substantially increases friction between the bottommost paper sheet and paper pickup mechanism 200, thus preventing movement of the bottommost paper sheet into the cutters during movement of the other paper sheets.

Reference is made to FIG. 2. The paper pickup mechanism 200 further includes a paper feeding board 205 located on and partially overlapped with the friction cushion 204. A second aperture 2052 is defined in the paper feeding board 205 at a location corresponding to the first aperture 2042 of the friction cushion 204. The paper feeding board 205 has smooth surface and in this embodiment, it is made of metal. In other embodiments, it may be made of other smooth material for example glass or the like. Arrangement of the smooth paper feeding board 205 on the friction cushion 204 helps reduce friction of the bottommost paper sheet when coming into the paper pickup mechanism. By this manner, the paper sheet is easily moved to toothed edges of the rollers 203.

Preferably, the upper portion of the paper separating board 120 is provided with a plurality of saw teeth 121. When the paper sheets are attached to each other by staples or clips, the saw teeth 121 are able to effectively obstruct the staples and clips such that these attached paper sheets will be stopped to move ahead, thus realizing easy separation of paper sheets by the paper pickup rollers and shredding of paper sheets.

A recess 101 is defined in a top portion of the chassis 10. A lower portion of the paper separating board 120 is provided with a pair of first sleeves 1204 at a lateral side thereof. The boar 120 may be pivoted to the chassis 10 by a shaft such that the board 120 is rotatable with respect to the chassis 10. When the paper sheets to be shredded are few and no attached paper sheets exist, there is no need to secure the paper separating board 120 onto the first paper supporting board 110. Specifically, the board 120 may be rotated into a horizontal orientation and hidden into the recess 101.

Preferably, the lower portion of the first paper supporting board 110 is hinged to the chassis 10. When the paper shredder is idle, the first paper supporting board 110 may be rotated to locate into the recess 101 horizontally and then cover the automatic paper feeding opening 104, thus reducing size of the shredder and preventing dust from coming into the chassis through the opening 104.

Preferably, as shown in FIG. 4, a front end of the second paper supporting board 206 is hinged to the holding bracket 201. A receiving groove 209 is defined in the hold bracket 201 at a location below the second paper supporting board 206. The receiving groove 209 has a resilient member 208 contained therein. Two ends of the resilient member 208 are resiliently pressed against the second paper supporting board 206 and holding bracket 201 respectively. Preferably, the resilient member 208 is a compression spring or resilient tab.

When the paper shredder 1 of this embodiment begins to operate, the paper sheets will in turn travel across the paper separating mechanism 100, paper pickup mechanism 200 and paper shredding mechanism 300.

Specifically, at first the paper sheets to be destructed are placed on the first paper supporting board 110. Then, the paper separating board 120 is turned and secured onto the first paper supporting board 110.

When paper sheets are not attached to one another, these sheets are moved one by one to the third paper supporting board 207 through the first paper supporting board 110. Next, the sheets are moved to the toothed edges of the rollers 203 via the smooth paper feeding board 205. When the rollers 203 drive the topmost sheet, friction between the bottommost sheet and pickup mechanism is increased effectively by the friction cushion 204, thus preventing movement of the bottommost paper sheet into the cutters during movement of the other paper sheets.

When the paper sheets are attached with each other and attached area of the sheets is away from the automatic paper feeding opening, the paper pickup rollers drive the upmost paper sheet such that the same paper sheet travels towards the automatic paper feeding opening. Because the paper sheets are attached together, they will curve due to force of the attached area. At this time, the paper separating board 120 will stop further curving and also stop turning of the first paper supporting board 110. In addition, counterforce is applied to the attached area of the paper sheets. At this time, the uppermost paper sheet will be separated from other sheets due to cooperation of the rollers and paper separating board 120, and then is delivered to the paper shredding mechanism. By the same token, other attached paper sheets are automatically separated from each other and shredded.

When the paper sheets are attached with each other and attached area of the sheets is close to the automatic paper feeding opening, automatic paper separation will not be realized by the paper separating mechanism 100 of the paper shredder 1. At this time, the attached paper sheets are moved into the third paper supporting board 207. Next, the sheets are moved further to the toothed edges of the rollers 203 with ease by the paper feeding board 205. When the paper pickup rollers 203 drive the upmost paper sheet, the attached paper sheets will be moved into the paper shredding mechanism altogether, whereas the bottommost paper sheet will not be moved into the paper shredding mechanism due to friction force of the friction cushion 204 imposed onto it.

When the paper sheets to be shredded are increased, as the axe is disposed below the second paper supporting board 206 and the resilient member (for example a compression spring) is disposed below the axe, the second paper supporting board 206 will move downward in response to thickness increase of the paper sheets for enlarging a gap between the rollers and friction cushion, thus ensuring easy pass of the paper sheets. Meanwhile, the compression spring is in a compressed state. After the paper sheets leave, the second paper supporting board 206 will again be moved upwards to its original position under resiliency of itself.

In addition, when an overly great number of paper sheets (exceeding the maximum capacity) are fed to the paper shredding mechanism, the paper shredder will start overload self-protection to withdraw the paper sheets, thus preventing paper jamming.

In a summary, for the paper shredder of this embodiment of the invention, due to existence of the paper separating mechanism and paper pickup mechanism, multiple attached paper sheets may be separated from each other or come into the paper shredding mechanism altogether for further shredding of sheets. By this manner, automatic paper sheet feeding is realized and human intervention is reduced, and operation efficiency is also improved.

FIGS. 6-9 show a second embodiment of the paper shredder 1 of the invention. This embodiment makes improvements to the first one and the differences are listed below.

A paper pickup mechanism 200 further includes a paper guiding unit (not labeled) mounted on the holding bracket 201. A guiding path is defined in the unit for guiding paper sheets. The paper guiding unit includes a first guiding shaft 210 mounted on the holding bracket 201 and parallel to the paper pickup roller axe 202, and a second guiding shaft 212. A plurality of first guiding rollers 211 is provided on the first guiding shaft 210 and similarly, a plurality of second guiding rollers 213 is provided on the second guiding shaft 212. The first guiding rollers 211 and second guiding rollers 213 together define the guiding path.

The first guiding shaft 210 and second guiding shaft 212 synchronously rotate with the paper pickup roller axe 202. In other words, they may be driven by a same motor. In other embodiments, the first guiding shaft 210 and second guiding shaft 212 may rotate independent of the paper pickup roller axe 202. That is, they may be driven by different motors.

Further, the first guiding rollers 211 and second guiding rollers 213 may be of gears with teeth on their circumferential surfaces. Moreover, the first guiding rollers 211 are configured to rotate counter-clockwise, while the second guiding rollers 213 to rotate clockwise. When the paper sheets enter the guiding path, the first guiding rollers 211 and second guiding rollers 213 squeeze the paper sheets with their teeth from below and over the sheets respectively, forcing the sheets to easily pass the guiding path and travel to the paper shredding mechanism 300, and avoiding paper jamming at a paper exit opening.

In other embodiments, the first guiding rollers 211 are configured to rotate counter-clockwise, while the second guiding rollers 213 are configured to keep stationary. Alternatively, the first guiding rollers 211 are configured to keep stationary, while the second guiding rollers 213 to rotate clockwise. When the paper sheets enter the guiding path, the first guiding rollers 211 and second guiding rollers 213 squeeze the paper sheets with their teeth from below and over the sheets respectively, forcing the sheets to easily pass the guiding path and travel to the paper shredding mechanism 300, and avoiding paper jamming at a paper exit opening.

Though various embodiments of the present invention have been illustrated above, a person of the art will understand that, variations and improvements made upon the illustrative embodiments fall within the scope of the present invention, and the scope of the present invention is only limited by the accompanying claims and their equivalents.

The invention claimed is:

1. A paper shredder, comprising a chassis on which an automatic paper feeding opening is defined, a paper shredding mechanism disposed inside the chassis, a paper separating mechanism located adjacent to the automatic paper feeding opening, and a paper pickup mechanism located between the paper separating mechanism and paper shredding mechanism;

the paper separating mechanism includes a first paper supporting board on which a fastening mechanism is provided and a paper separating board cooperating with the fastening mechanism and capable of being fixed onto the first paper supporting board, the first paper supporting board defining together with the paper separating board a paper supporting area for receiving paper sheets to be shredded; and the paper pickup mechanism includes a holding bracket secured on the chassis, a paper pickup roller axe mounted on the holding bracket, a plurality of paper pickup rollers sleeved on the axe, a second paper supporting board located below the plurality of rollers and secured onto the holding bracket, and a third paper supporting board located above a distal end of the second paper supporting board and connected with the paper separating mechanism;

wherein the paper pickup mechanism further includes a friction cushion located between the paper pickup rollers and the second paper supporting board; and a first aperture is defined in the friction cushion and faces the paper pickup rollers.

2. The paper shredder as recited in claim 1, wherein the paper pickup mechanism further includes a paper feeding board which is located between the third paper supporting board and the friction cushion and one end of which is exposed out of a front end of the third paper supporting board; and a second aperture is defined in the paper feeding board at a location corresponding to the first aperture of the friction cushion.

3. The paper shredder as recited in claim 2, wherein the paper feeding board is made of metal.

4. The paper shredder as recited in claim 1, wherein the second paper supporting board is hinged to the holding bracket; and a resilient member is disposed below a distal end of the second paper supporting board, the resilient member being resiliently pressed against the second paper supporting board.

5. The paper shredder as recited in claim 4, wherein the resilient member is a compression spring or resilient tab.

* * * * *